US009435163B2

(12) United States Patent
Wilson

(10) Patent No.: US 9,435,163 B2
(45) Date of Patent: Sep. 6, 2016

(54) METHOD AND APPARATUS FOR REMOVING LIQUID FROM A HORIZONTAL WELL

(71) Applicant: Scott J. Wilson, Littleton, CO (US)

(72) Inventor: Scott J. Wilson, Littleton, CO (US)

( * ) Notice: Subject to any disclaimer, the term of this patent is extended or adjusted under 35 U.S.C. 154(b) by 12 days.

(21) Appl. No.: 14/316,087

(22) Filed: Jun. 26, 2014

(65) Prior Publication Data

US 2014/0305652 A1 Oct. 16, 2014

Related U.S. Application Data

(63) Continuation of application No. 13/652,752, filed on Oct. 16, 2012, now Pat. No. 8,794,305.

(60) Provisional application No. 61/550,651, filed on Oct. 24, 2011.

(51) Int. Cl.

| | |
|---|---|
| ***E21B 21/16*** | (2006.01) |
| ***E21B 43/12*** | (2006.01) |
| ***E21B 17/20*** | (2006.01) |
| ***E21B 37/00*** | (2006.01) |

(52) U.S. Cl.

CPC ..... *E21B 21/16* (2013.01); *E21B 17/203* (2013.01); *E21B 37/00* (2013.01); *E21B 43/123* (2013.01)

(58) Field of Classification Search

USPC ..... 166/372, 53, 68; 417/142, 138, 144, 417/145, 149; 137/205, 135, 155

See application file for complete search history.

(56) References Cited

U.S. PATENT DOCUMENTS

| | | | | |
|---|---|---|---|---|
| 1,853,269 | A | 4/1932 | Harris | |
| 2,565,616 | A | 8/1951 | Mennesson | |
| 2,960,998 | A * | 11/1960 | Sinker | F16K 1/46 137/542 |
| 3,381,753 | A * | 5/1968 | Fredd | E21B 43/14 137/112 |
| 3,894,814 | A | 7/1975 | Morgan | |
| 3,991,825 | A | 11/1976 | Morgan | |
| 4,021,147 | A | 5/1977 | Brekke | |
| 4,181,470 | A | 1/1980 | Gillett | |
| 4,427,345 | A | 1/1984 | Blann | |
| 4,527,633 | A | 7/1985 | McLaughlin | |
| 4,726,420 | A | 2/1988 | Weeks | |
| 5,006,046 | A | 4/1991 | Buckman | |
| 5,211,242 | A | 5/1993 | Coleman | |
| 5,671,813 | A | 9/1997 | Lima | |
| 6,672,392 | B2 | 1/2004 | Reitz | |
| 7,100,695 | B2 | 9/2006 | Reitz | |
| 7,744,352 | B2 | 6/2010 | Parr | |
| 7,789,158 | B2 | 9/2010 | Zupanick | |
| 7,819,197 | B2 | 10/2010 | Khoshnevis | |
| 2007/0235197 | A1 * | 10/2007 | Becker | E21B 43/122 166/372 |
| 2009/0008101 | A1 | 1/2009 | Coady | |

OTHER PUBLICATIONS

International Search Report & Written Opinion for International Application No. PCT/US2012/060378 mailed Mar. 12, 2013.

* cited by examiner

*Primary Examiner* — David Andrews
*Assistant Examiner* — Ronald Runyan
(74) *Attorney, Agent, or Firm* — Swanson & Bratschun, L.L.C.

(57) ABSTRACT

A system and method for removing liquid from a horizontal wellbore is disclosed. The system and methods utilize multi-conduit tubing associated with one or more liquid intake port(s) positioned at selected locations along the tubing and positioned within a wellbore. The one or more liquid intake ports are typically placed at liquid accumulation points along the primarily horizontal section of the wellbore.

16 Claims, 5 Drawing Sheets

METHOD AND APPARATUS FOR REMOVING LIQUID FROM A HORIZONTAL WELL

RELATED APPLICATION DATA

This application is a continuation of U.S. patent application Ser. No. 13/652,752, filed on Oct. 16, 2012, which claims the benefit under 35 USC §119(e) of U.S. Provisional Patent Application No. 61/550,651, filed Oct. 24, 2011, the contents of which are herein specifically incorporated by reference in their entireties.

TECHNICAL FIELD

The embodiments disclosed herein relate to the field of horizontal well fluid removal. More particularly, the disclosed embodiments relate to the removal of well fluid accumulated within the sumps or other liquid accumulation portions of the horizontal section of an oil and/or natural gas well using pressurized gas delivered from the surface.

BACKGROUND

The accumulation of liquids in oil and natural gas wells restricts the flow of hydrocarbons from the producing formation into the bore hole. Reduced flow occurs when hydrostatic pressure exerted on the face of the producing formation reduces pressure drawdown, and liquids accumulated across from producing zones causes a reduction in gas or oil flow by saturating pore spaces with water or other liquids.

During the initial production period of a horizontal gas well, the gas velocity in the entire wellbore is sufficient to remove liquids from the well unassisted. As productivity naturally declines, there will eventually be insufficient pressure to overcome the hydrostatic head created by fluid accumulation in the vertical and horizontal sections of the well bore. Another contributing factor to gas well productivity decline is the accumulation of formation water or liquid hydrocarbons in the horizontal well bore across from gas productive perforations. This fluid accumulation will cause a reduction in gas relative permeability by saturating the pore throats near the wellbore with liquids. Similar effects occur in oil wells where water accumulates in the horizontal section, increasing hydrostatic pressure and decreasing oil relative permeability.

To maximize the returns from an oil/gas well, it is important to remove any restrictions to flow caused by wellbore liquids accumulation. When a well rate falls due to liquid loading, it is often necessary to periodically install mechanical equipment to remove liquid from the bore hole and reduce the hydrostatic head. This operation decreases the economic efficiency of the well, requires additional supervision, maintenance and equipment.

Several methods have been devised for removal of liquids from a bore hole, each having their own particular advantages and disadvantages. Usually a plunger is installed when a gas well has difficulty flowing naturally. This method lifts liquids from low rate gas wells by allowing the well to build pressure between flow cycles and lift complete slugs of liquid with each plunger stroke. The drawback to this technique is that during shut-in periods, accumulated liquids are driven back into the formation by pressure building in the tubing. Because the gas flow is intermittent, wellbore damage occurs during each shut-in period. Finally, a plunger cannot work consistently if the surface build-up pressure is not at least twice the line pressure that the well flows into. This method is not applicable for wells with significant deviation from a substantially vertical and linear wellbore configuration that restricts the free-fall of the plunger to the bottom of the well.

Another method of removing liquids is by pumping the liquid out of the casing with a long sucker rod operated by a pump jack at the surface. This method is not applicable for wells with significant deviation from a substantially vertical and linear wellbore configuration (also known as "doglegs") that restrict the ability of the rod string to naturally fall on the downstroke. Deviations in the wellbore will cause wear on the rods and tubing during the upstroke. A modification of the sucker rod pumping method involves rotating progressive cavity pumps which use rotating rods and do not require a vertical return. This method also has drawbacks since rotating sucker rods will wear and break due to alternating bending stresses around the curves in a horizontal well. Downhole electric pumps use no rods but are inefficient in low liquid rate horizontal wells due to short run lives, gas locking and high equipment costs.

A method better suited for curved wellbores is known by those skilled in the art as "gas lift." This widely used method involves injecting gas down one flow path with the intent of lightening the fluids returning up another flow path. This gasification reduces the density of the produced fluids and facilitates the flow to the surface as long as reservoir pressure remains high enough to lift the gasified column of fluid.

"Continuous" and "intermittent" are the two classes of gas lift. In continuous gas lift installations, lift gas is continuously injected into the annulus, flowing down to a port at the bottom of the well, and returning up a second conduit with the produced fluids. For intermittent gas lift installations, the well is produced without injecting gas until liquid accumulation causes a reduction in flow capacity. Then, gas is injected into the annular space to re-start flow. Lift gas is removed once the well can flow unassisted.

Chamber lift is a specialized form of intermittent gas lift where an accumulation chamber is used to collect a designated volume of liquid in a fixed chamber, one side of a concentric string, or the bottom of a U-tube in a vertical wellbore. This accumulated liquid is periodically circulated to the surface using pressurized gas introduced into one conduit of the u-tube or concentric string at the surface, forcing the liquids up the other side.

A device patented by Buckman discussed in U.S. Pat. No. 5,006,046 is a downhole U-tube designed exclusively for vertical wells and is actuated with pressure in the flowing wellbore. Since the system is driven by formation pressure, a high formation pressure is required to lift a complete slug of liquid to the surface. High formation pressure is rarely present in mature gas wells.

The typical lack of high formation pressure was addressed by Reitz (U.S. Pat. Nos. 6,672,392 and 7,100,695) using one small conduit fully contained within a second, larger concentric conduit with the liquid intake port at the extreme end. Using high pressure gas delivered at the surface, this device is designed to lift liquids from the bottom of a vertical wellbore. This method may be applied to horizontal wells but the method is limited by the amount of liquid that can be accumulated per cycle since the liquid intake is at the bottom of the device and no liquid accumulation is possible toward the toe of the wellbore. The Reitz disclosures also do not provide a means of venting gas bubbles that will limit liquid accumulation. Furthermore, the amount of liquid that can be collected is limited to the volume that can be contained in the relatively small diameter pipe over a few hundred feet of length.

Another enhancement to the Buckman system was described by Lima in U.S. Pat. No. 5,671,813 where two production strings are used to lift a vertical well using a circulating mechanical interface. This system is limited by the inability to lift from around the heel of a horizontal well since the liquid intake is at the extreme end of the apparatus, and the only area for accumulation of liquids is again the amount that can be lifted by reservoir pressure toward the wellhead.

SUMMARY OF THE EMBODIMENTS

One embodiment includes an apparatus and method for removing liquid from a horizontal well using multi-conduit tubing, associated with one or more liquid intake port(s) and vent port(s) positioned at selected locations along the tubing, and surface supplied pressurized gas. The disclosed system and method embodiments include a multi-conduit tubing run into a wellbore. One or more liquid intake ports are placed at liquid accumulation points along the primarily horizontal section of the wellbore. One or more vent housings are placed at gas accumulation points along the primarily horizontal section of the wellbore.

In use, pressure is released in all conduits to allow accumulated water in the wellbore to flow naturally into at least two of the conduits through intake check valves. While the multi-conduit is filling, trapped gas in the conduit can be vented to the surface through a vent line, allowing complete or "best possible" fillage of the horizontal section of the multi-conduit.

Once sufficient time has been provided for liquid inflow to fill the conduits, pressurized gas is injected in one or more conduits, forcing check valves closed at the intake ports and lifting the accumulated liquid slugs up the remaining unpressurized conduit(s). If liquid sweep is insufficient, small spheres can be introduced with the pressurized gas at the surface and circulated back to the surface, pushing a slug of accumulated liquid.

In some embodiments, timer or sensor controlled valves are connected to each of the conduits at the surface so that gas can be intermittently injected into the conduit(s) to circulate liquids to the surface. A mechanism may be provided for opening and closing the valves. When the valves are open to a low pressure slug catcher or liquid collection tank, liquid will accumulate in the multi-conduit through the openings at the sumps in the horizontal sections of the wellbore. Alternately, when high pressure gas valves are open to part of the multi-conduit, gas will force the liquid through the remaining conduits and out of the well.

Certain specific embodiments disclose a system for removing liquid from a wellbore generally as described above. The system comprises a multi-conduit including at least two pipes extending into the wellbore from the surface of the wellbore and at least one intake port in fluid communication with at least one pipe of the multi-conduit. The intake port includes a liquid passage extending from the interior of the multi-conduit to the exterior of the intake port and a check valve operatively associated with the liquid passage providing for the liquid passage to be closed when pressure inside the multi-conduit exceeds pressure outside the liquid passage. This check valve configuration provides for the liquid passage to be open when the pressure outside the liquid passage exceeds the pressure inside the multi-conduit. The system also includes a connection between at least two pipes of the multi-conduit providing for fluid communication between the two pipes.

In selected system embodiments, the connection comprises one or more vent housings positioned in fluid communication with the multi-conduit providing for fluid communication between at least two pipes of the multi-conduit. Multiple vent housings with one vent housing being positioned at the end of the multi-conduit opposite the surface of the wellbore can be used as well.

In certain embodiments, the multi-conduit comprises a first fluid accumulation pipe in fluid communication with the liquid passage of at least one intake port; a second fluid accumulation pipe in fluid communication with the liquid passage of at least one intake port and a vent pipe in fluid communication with the first fluid accumulation pipe and the second fluid accumulation pipe at one or more vent housings. Additionally, the system may include one terminal vent housing located at the end of the multi-conduit opposite the surface of the wellbore and providing for fluid communication between the first fluid accumulation pipe, the second fluid accumulation pipe and the vent pipe; and one or more in-line vent housings located between the end of the multi-conduit opposite the surface of the wellbore and the surface of the wellbore and providing for fluid communication between the first fluid accumulation pipe, the second fluid accumulation pipe and the vent pipe.

System embodiments may also include a pressurized gas source such that the fluid accumulation pipe or pipes and the vent pipe or pipes may be selectively pressurized by the application of a pressurized gas.

The apparatus described herein may be implemented in any desired configuration; however, typically at least one intake port is operatively positioned in a horizontal portion of a wellbore at a location where liquid accumulates. Similarly, at least one of the vent housing(s) is typically operatively positioned in a horizontal portion of a wellbore at a location where gas accumulates.

The intake port or ports may optionally include a back-flush port positioned adjacent to the liquid passage and extending from the multi-conduit to the exterior of the intake port, wherein the back-flush port is oriented such that liquid flowing through the back-flush port when the pressure in the multi-conduit exceeds the pressure outside the liquid passage clears debris from the liquid passage.

Various methods of removing liquid from a wellbore using the apparatus described above are also disclosed herein. Also disclosed are various embodiments of an intake port as described above.

DETAILED DESCRIPTION

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Figure 1:
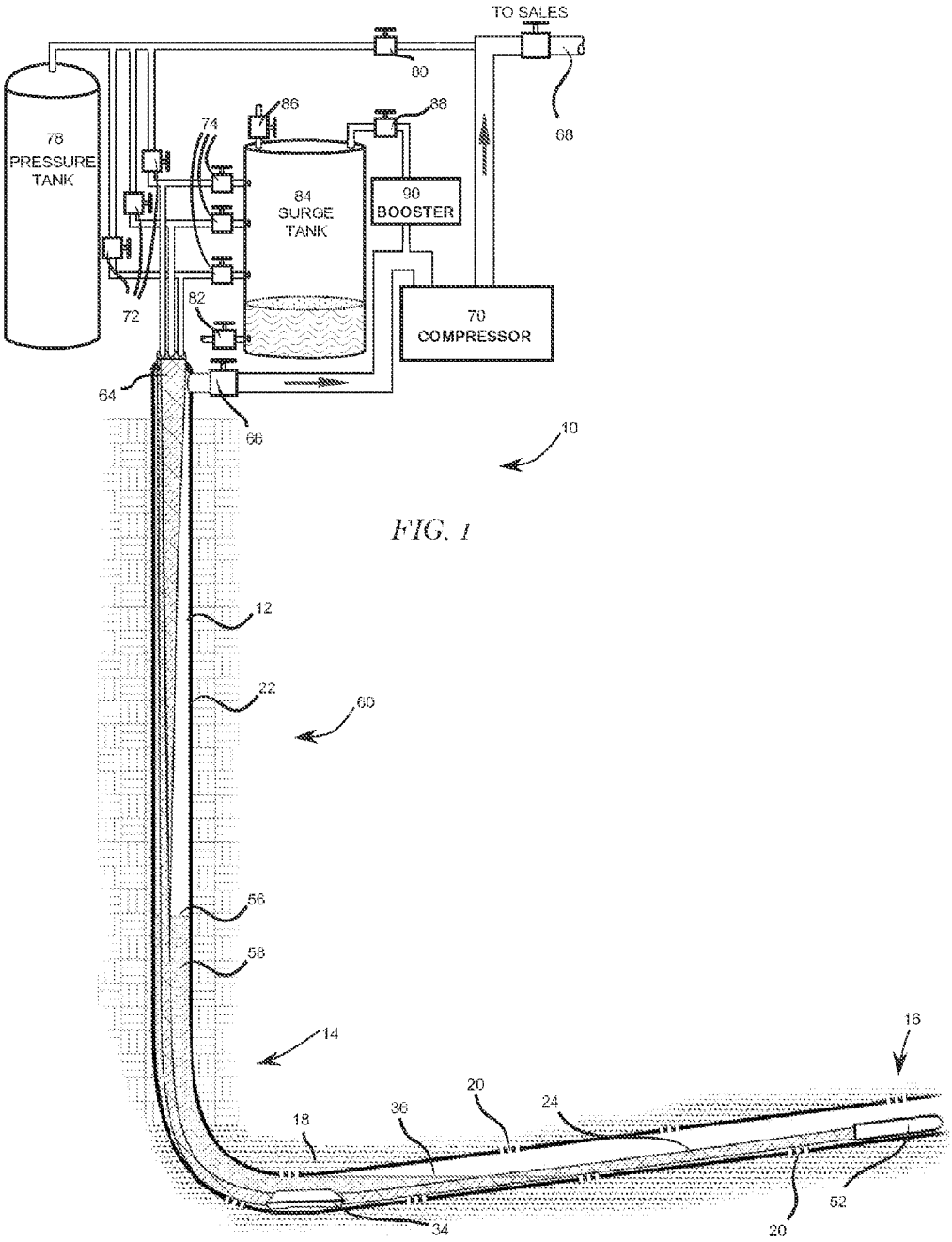
FIG. 1 is a schematic sectional view of a simple "toe-up" horizontal bore hole unloading system consistent with the embodiments disclosed herein. "Toe-up" indicates that the end of the horizontal wellbore is higher than the heel portion.

FIG. 1 shows selected elements of one embodiment of a liquid lifting system 10 as disclosed herein. The system 10 is positioned substantially within the horizontal portion of a bore hole 12. The bore hole 12 extends from ground level down around a heel portion 14 to the toe portion 16 of the well trajectory. The oil and /or gas formation is denoted by strata 18. Hydrocarbon flow enters the wellbore from a plurality of perforations 20 at selected locations along the bore hole casing 22, and fills horizontal section of said wellbore with gas and liquids. As used herein, the term hydrocarbon collectively describes oil or liquid hydrocarbons of any nature, gaseous hydrocarbons and any combination of oil and gas hydrocarbons. In general, as liquid enters a multi-conduit 24 through check valves in each of one or more in-line intake port housings 34 as disclosed herein. The structure and operation of the multi-conduit 24 and intake port housings 34 are described in detail below. As used herein, "liquid" includes water, oil or any combination of water and oil. The horizontal section of the multi-conduit 24 fills with liquid. As described in detail below, trapped gas in the multi-conduit 24 is vented from a vent housing 52 through a central pipe of the multi-conduit. The one or more vent housings 52 will be typically be located at the highest point(s) in the horizontal section of the wellbore and will have a U-tube connection that allows passage of fluids from one outside conduit to the other.

As described below, the multi-conduit 24 may be implemented with a substantially parallel array of two or more pipes or tubes. For ease of description, the multi-conduit 24 is generally described herein as being a parallel array of three pipes. Thus, reference is made to the two outside pipes and possibly one inside pipe of a multi-conduit 24 in the present disclosure and figures. It is important to note that the various embodiments disclosed herein can be implemented with multi-conduit elements having any number of pipes or tubes arranged in any desired fashion.

Figure 2A:
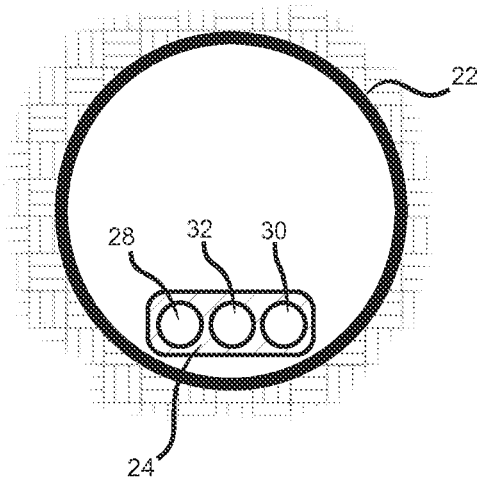
FIG. 2A is a schematic sectional view of one placement of multi-conduit as disclosed herein.
Figure 2B:
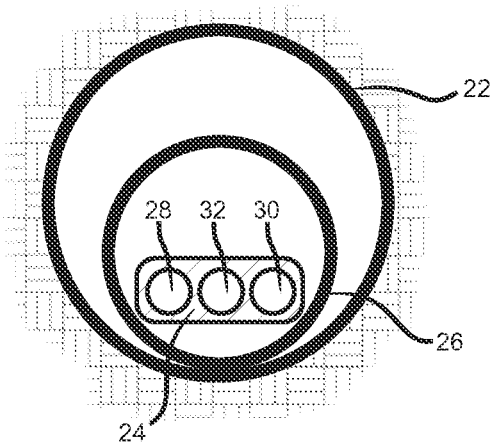
FIG. 2B is a schematic sectional view of an alternative placement of multi-conduit as disclosed herein.
Figure 2C:
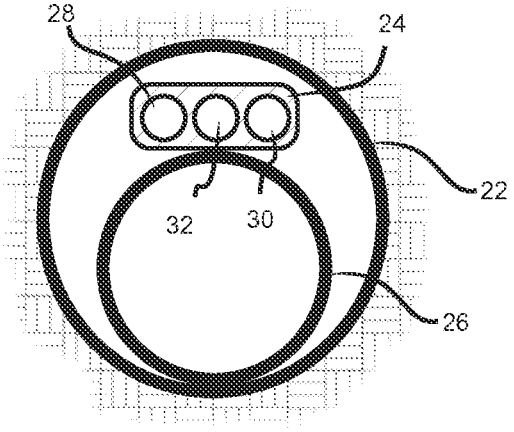
FIG. 2C is a schematic sectional view of another alternative placement of multi-conduit as disclosed herein.

FIGS. 2A, 2B and 2C show several alternative placements of the multi-conduit 24 within the wellbore. As illustrated in FIG. 2A, the multi-conduit 24 can be run in an open production casing 22. Alternatively, as shown in FIG. 2B, the multi-conduit could be run within a secondary tubing or pipe 26 within the casing 22. As shown in FIG. 2C the multi-conduit could also be run outside of a tubing or pipe 26 run within the casing 22. Other more complex configurations of the multi-conduit 24 with respect to the casing 22 are within the scope of this disclosure.

FIGS. 2A-2C further illustrate the multi-conduit being configured to have two outside pipes 28 and 30 as noted above plus one inside vent pipe 32. The configuration and number of multi-conduit pipes may be varied to achieve specific operational goals, provided the overall functionality of the multi-conduit 24, as described herein is not compromised.

Figure 3A:
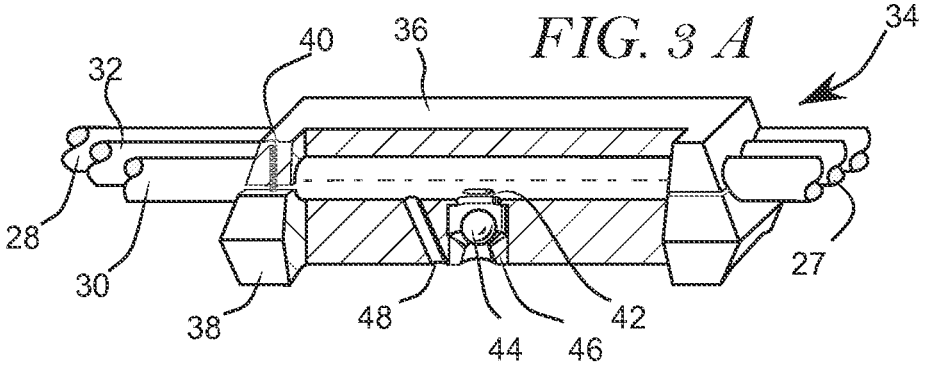
FIG. 3A is a sectional view of an embodiment of an in-line intake port as disclosed herein.
Figure 3B:
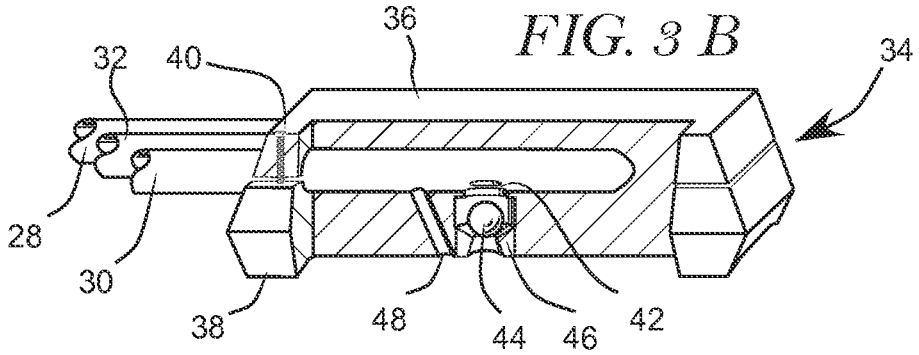
FIG. 3B is a sectional view of an embodiment of a terminal intake port as disclosed herein.
Figure 3C:
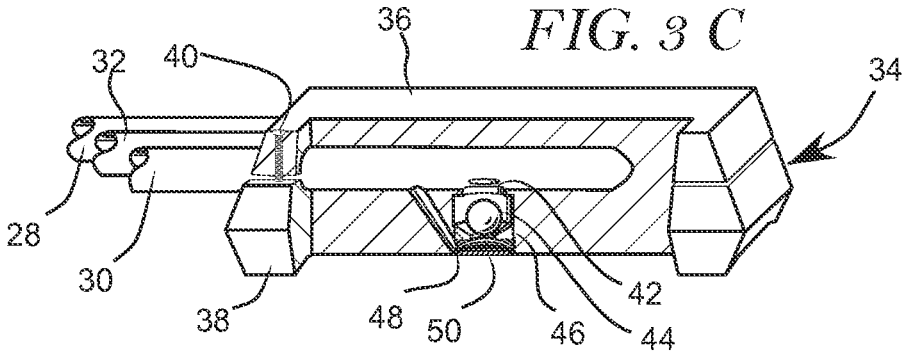
FIG. 3C is a sectional view of an alternative embodiment of a terminal intake port.

FIGS. 3A, 3B and 3C provide detailed cut-away views of various embodiments of intake ports 34 which may be placed, as described below, along and in-line with the multi-conduit 24 or at the end of the multi-conduit 24. The intake ports 34 may be positioned in fluid communication with the multi-conduit 24 by any means, for example by attaching upper and lower housing portions, 36 and 38 respectively to opposite sides of the multi-conduit 24. The housing portions 36 and 38 may be held together by screws 40 or other suitable connectors that fall between the conduit pipes.

The intake ports 34 will include holes 42, created through the housing in one or more of the outside lines 28, 30 where liquid can enter the multi-conduit 24. Check valve balls 44 and seats 46 are threaded into or otherwise attached to the housing just below each of the holes 42 in the outside lines to provide a precise and durable one-way seal. The intake port embodiments disclosed herein could be implemented with alternative check valve types or configurations.

Optionally, a back-flush port 48 can be included with an intake port 34, in fluid communication with the outside lines and used to automatically flush debris from the entrance of the intake port check valves on each pressurization cycle. FIG. 3C shows the back-flush port positioned above a screened intake 50. This position enables solids to be back-flushed from the upstream side of the screen if those screens are found to become plugged with solids carried with produced liquids. For implementations where an intake housing is mounted at the end of the multi-conduit, (see for example FIG. 4B,) the housing will include a U-tube as described below so that flow can move from one pipe to the other as liquid is forced by pressure back to the surface.

Figure 4A:
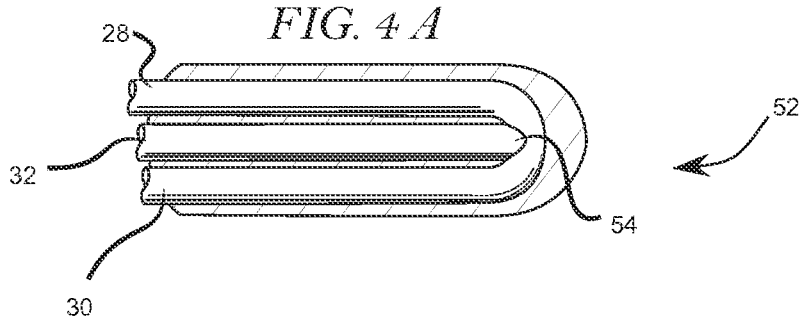
FIG. 4A is a schematic sectional view of a terminal vent housing as described herein. It includes an internal U-tube to allow fluids to circulate from one conduit to the others.
Figure 4B:
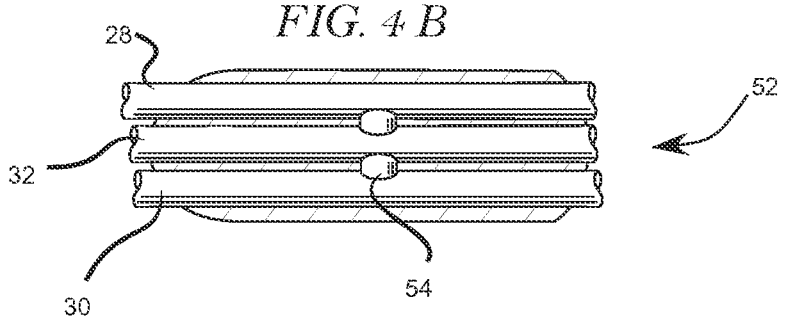
FIG. 4B is a schematic sectional view of an in-line vent situated at a local high spot within the horizontal section.

FIG. 4A shows a U-tube vent housing 52 that is suitable for mounting to the end of a multi-conduit 24. The first function of the various types of vent housings is to connect the two outside pipes 28 and 30 within the multi-conduit 24 so that fluids can be circulated to the surface from one side (28 for example) while applying pressure to the other side (30 for example). As noted above, the multi-conduit 24 may be implemented with any number of pipes or tubes in any configuration provided the basic principles of operation disclosed herein are maintained. The optional third line 32 is used as a combination vent/gas injection line to optimize operation of the system. In systems where only two conduits are used in the multi-conduit 24, as liquids fill the multi-conduit, gas bubbles will move to the high points and eventually restrict additional influx of liquids. In embodiments where three lines are used, the inter-pipe connections within vent housings 52 provide for the release of gas pressure and allow the complete filling of the multi-conduit during the liquid collection phase described in detail below. During the liquid production phase, the vent line 32 is pressurized with gas to keep liquid from flowing into it and to inject gas throughout the liquid column from jumper connections 54 between the vent line 32 and the production line(s) 28 and 30. The extra gas introduced to the liquid slug helps to lift the liquid with lower injection pressure requirements. When a vent housing 52 is positioned away from the end of a multi-conduit, in-line with the multi-conduit 24, a flow-through vent housing embodiment is used to provide the above described venting and pressurization functions as shown in FIG. 4B.

Referring back to FIG. 1, one or more of the two outside pipes 28 and 30 in a multi-conduit 24 will fill with liquid to the level 56 of fluid 58 in the vertical section 60 of a bore hole 12, even though the liquid level on the upstream side of the heel will remain at the gas spill point 36. The vertical portion of the multi-conduit 24 is sealed off against the top of the wellbore at the surface 64.

Produced gas may be continuously removed from the casing 22 or tubing through production valve 66. Gas can flow directly to the sales line 68 or to a compressor suction manifold 70 where wellhead gas is boosted to gathering system pressure. Produced gas can be removed from the wellbore while the multi-conduit is being filled or while it is being evacuated to the surface as described in more detail below.

After the multi-conduit 24 is full of liquid, selected valves 72 at the surface 64 are opened, supplying highly-pressurized lift gas to one or more of the pipes of the multi-conduit 24. The vent line can also be pressurized to assist liquid lift by opening the appropriate valve 72 with opposite valve 74 closed. Pressurized gas can be supplied by centrally compressed lift gas or by on-site compression through compressor 70 and compressed gas storage 78. Valve 80 may be used to divert high pressure sales gas to use as lift gas stored for intermittent cycles. With pressurized gas quickly working down one side of the multi-conduit (28 or 30) and the vent-line 32, pressure in the multi-conduit 24 will increase, automatically forcing the check valves closed in the port housing(s) 34. The increased pressure on one side of the multi-conduit 24 and the gas vent line 32 will send the accumulated liquid slug toward the opposite, evacuated side of the multi-conduit 24. Thus, the gas behind one side of the conduit will push the slug ahead of it, while the vent line will add gas to the liquid slug as it traverses around the U-tube 52, decreasing the density of the liquid slug as it works its way to the surface. For particularly deep wells, pressurized gas can be supplied to the entire liquid slug with multiple gas delivery points in the vent line 32.

With valve 72 open, the high pressure gas slug circulating toward the surface will drive a fluid slug up the remaining low pressure (outside) conduit toward the surge tank 84. Liquid is removed from the surge tank 84 for disposal or sales through dump valve 82. Valve 88 leading to a gas booster suction 90 and vent valve 86 will cooperate to maintain pressure in the surge tank 84 and evacuated conduit at or near atmospheric pressure during the liquid slug production phase.

Another embodiment of the system 10 consists of all elements noted above but with additional connections and valves to allow reversed flow through the various conduits when compared to the normal operation. Yet another embodiment consists of all the elements in the system described above but with circulating spheres within the multi-conduit 24 that are used to provide a more complete sweepage of liquid slugs to the surface.

Figure 5:
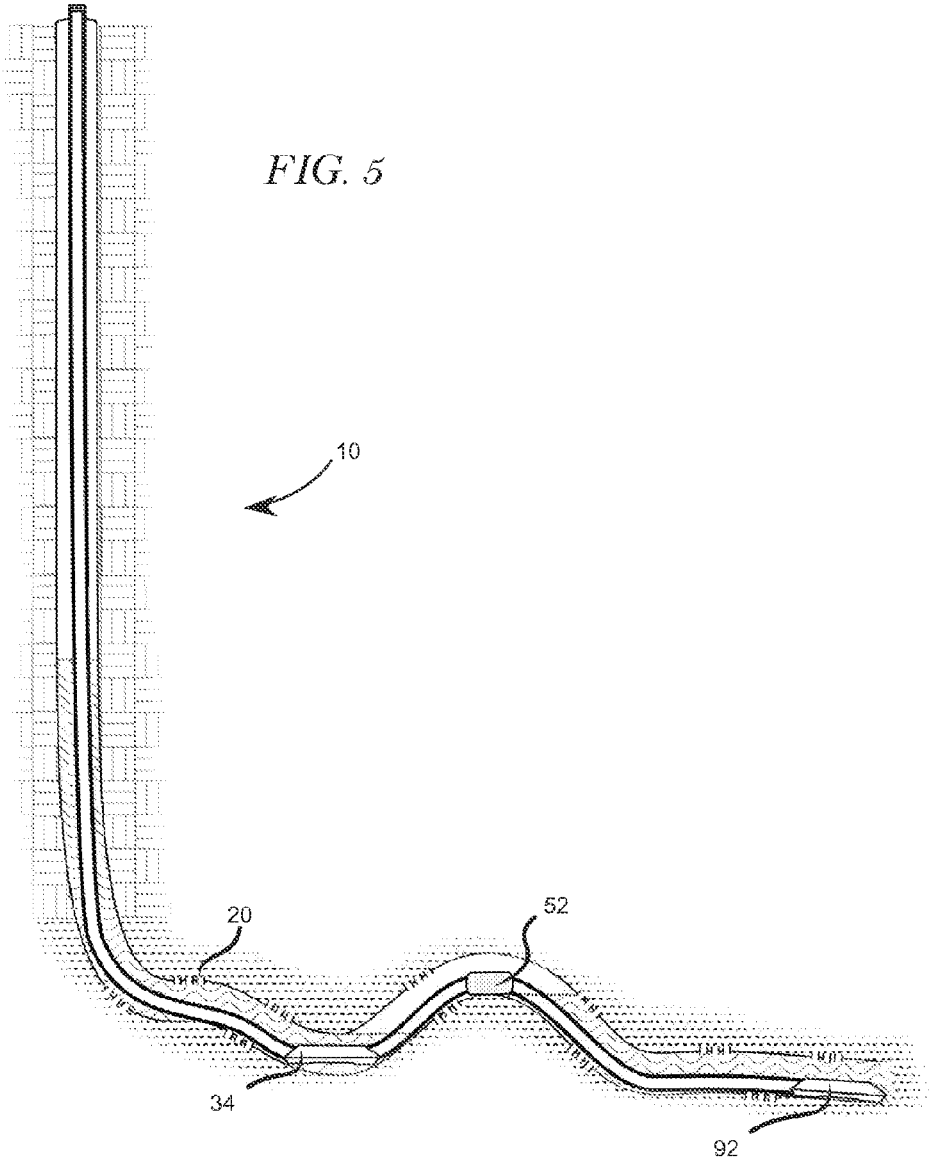
FIG. 5 is a schematic sectional view of portions of the disclosed system installed in an undulating horizontal bore hole.

FIG. 5 shows another embodiment featuring a system 10 having multiple intake ports 34 installed at each low point in the wellbore trajectory. In any commercial implementation of the disclosed apparatus and methods one or any number of intake ports 34 may be disposed along the multi-conduit and at the end of the multi-conduit 24. For example, a typical installation might feature 1, 2, 5, 10, 15, 20, 25 or a greater number of intake ports 34 installed typically with one intake port 34 at each low point in the wellbore trajectory. In addition, vent housings 52 can be placed anywhere along or at the end of the multi-conduit 24, typically at significant gas accumulation points in the wellbore that are not at the toe of the well as show in FIG. 1. In any commercial implementation of the disclosed apparatus and methods one or any number of vent housings may be disposed along the multi-conduit. For example, a typical installation might feature 1, 2, 5, 10, 15, 20, 25 or a greater number of flow-through vent housings. An intake port housing with an integral U-connection 92 can be installed in a toe-down terminal location to both collect liquids and connect the two accumulation conduits on the recovery stage.

Operation

Referring to FIG. 1, a typical horizontal gas well has production casing running from the surface to the toe of the horizontal section. In some cases, the production casing is run only in the vertical section while the horizontal section is completed with a slotted liner or open hole. Finally, production tubing is typically run to provide a small diameter, high velocity flow or artificial lift conduit.

Wells best suited for the lift methods and apparatus as disclosed herein are horizontal wells that exhibit liquid loading behaviors or reduced production rates due to liquid accumulation in the wellbore. Since wells with plungers or sucker rod pumps remove liquid only from the vertical portion of the wellbore, these wells are also good candidates for the described methods. Even those wells that consistently unload the vertical production tubing will have liquid loaded horizontal sections due to the lower velocities in the larger ID horizontal section.

Candidate wells can be selected based on their inability to flow consistently and other liquid loading indicators. Referring to FIGS. 1 and 5, intake ports 34 and 92, are located at positions along the wellbore expected to be liquid filled sections. Vent housings 52 are located at positions along the wellbore typically expected to be gas filled. The locations of likely liquid and gas accumulation in the horizontal section can be determined using a wellbore deviation survey, flow velocity correlations, direct sensing, or other methods. Intake ports 34 are thus attached to the multi-conduit tubing at the sump locations. Vent housings 52 are attached to the conduit where the high points in the horizontal section occur. A terminus U tube vent housing is placed at the end of the multi-conduit 24 to provide a return path for lift gas circulating down the apparatus.

The apparatus may be installed using a coiled tubing unit or other suitable means to place the multi-conduit 24 within the borehole. The multi-conduit is run into the horizontal section as far as possible to create the largest possible capture volume for liquid. If surface gas injection pressure is too low to evacuate an aerated column of liquid, a shorter installation may be optimal.

During normal operation, liquid is allowed to fill the multi-conduit through the intake ports. The amount of time needed to fill the conduit will be a function of the flow restriction in the intake check valves, the wellbore pressure at the sump locations and the minimum pressure that can be achieved in the evacuated multi-conduit. If the liquid production rate from the formation is low, the conduit may not fill completely. Once the optimal time has been determined to have passed, pressurized gas is supplied to the multi-conduit by operating selected valves 72 and 74. High pressure gas flows to two conduits: one side of the multi-conduit, for example pipe 28 or 30, but not both and the vent line 32 if used. The high pressure gas in these two lines forces the intake port check valves (elements 44 and 46 or an alternative check valve) closed and any fluids within the system are then forced up the remaining unpressurized line. The vent line 32 is pressurized to prevent it from filling with liquid and to provide gas to the liquid slug as it passes by the vent housings 52. The lift gas provided by the vent line decreases the density of the liquid slug being circulated to the surface.

After sufficient high pressure gas charge is supplied to the multi-conduit, valves 72 are closed to preserve lift gas for the next cycle. Meanwhile the pressurized gas in one conduit will force the accumulated liquid around the terminal U bend into the low pressure conduit and to the surface. The valve 74 connected to the low pressure conduit typically remains open to allow the liquid slug to be emptied into the surge tank 84. Lift gas produced with the liquid is re-compressed through a booster compressor and sent to sales or the gathering system.

After the complete slug is produced, the pressure in the entire system is bled down through surge tank valve 88 and perhaps tank vent valve 86. With the pressure in the conduit now lower than the pressure in the fluids opposite the intake ports 34, intake port check valves will open and a new slug of fluids will accumulate in the multi-conduit 24.

For wells that require lifting large slugs or that have low injection pressure, significant lift gas can be delivered from the vent line 32 throughout the length of a long slug enabling any size slug to be lifted. Alternatively, if large slugs are only experienced occasionally, pressure can be exerted on all multi-conduit pipes, forcing part of the liquid slug out the conduits through the intake port back-flush ports 48. A third alternate method of removing an occasional large slug is to circulate both liquid and gas down one side of the multi-conduit, thus generating a higher bottom-hole pressure to lift the liquid up the other side.

When the need arises to remove the multi-conduit 24, circulating ports in the mandrels can be opened to circulate completion fluids and remove any debris that might constrain the movement of the multi-conduit.

EXAMPLE

A typical 0.5 inch ID multi-conduit may be installed in a 4000 foot deep well with a 4000 foot horizontal section making a total well length of 8000 ft of wellbore. Using a typical 0.1 psi/ft gradient for an aerated fluid column, 400 psi lift gas pressure would be required to displace a column of aerated liquid to the surface. Using a multi-conduit unit volume of 0.5 barrels/1000 linear feet, a full charge of 2 barrels of liquid could be lifted on each cycle. Although the volume of lift gas required to unload liquid to the surface on each cycle depends on vent mandrel rates, approximately 200 scf of 400 psia lift gas will be required per cycle. Thus, the disclosed system and apparatus can result in a lift gas to liquid lifted ratio of 100 scf/bbl.

The required time per cycle will be dependent on well-specific parameters, but using reasonable fillage and unloading times, lifting up to 100 barrels of liquid per day is possible.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure. While the embodiments disclosed herein have been particularly shown and described with reference to a number of alternatives, it would be understood by those skilled in the art that changes in the form and details may be made to the various configurations disclosed herein without departing from the spirit and scope of the disclosure. The various embodiments disclosed herein are not intended to act as limitations on the scope of the claims. All references cited herein are incorporated in their entirety by reference.

What is claimed is:

1. A system for removing liquid from a wellbore comprising:

a multi-conduit comprising at least two pipes extending into the wellbore from the surface of the wellbore, along a wellbore trajectory to a terminal end of the multi-conduit;

at least one intake port positioned within the wellbore, the intake port being in fluid communication with at least one pipe of the multi-conduit, wherein the intake port is configured to allow a quantity of wellbore liquid adjacent to the intake port to pass through a liquid passage, from outside of the multi-conduit to an interior region of the multi-conduit; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit; and a fluid connection between the at least two pipes of the multi-conduit, wherein the fluid connection comprises a U-tube connection located at the terminal end of the multi-conduit and the intake port is positioned between the terminal end of the multi-conduit and a portion of the multi-conduit adjacent to the surface of the wellbore.

2. A system for removing liquid from a wellbore comprising:

a multi-conduit comprising at least two pipes extending into the wellbore from the surface of the wellbore, along a wellbore trajectory comprising at least one horizontal wellbore section, to a terminal end of the multi-conduit;

at least one intake port positioned within the wellbore, the intake port being in fluid communication with at least one pipe of the multi-conduit, wherein the intake port is configured to allow a quantity of wellbore liquid adjacent to the intake port to pass through a liquid passage, from outside of the multi-conduit to an interior region of the multi-conduit; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit; and a fluid connection between the at least two pipes of the multi-conduit, wherein the intake port is positioned at a low point in the wellbore trajectory within the horizontal wellbore section between the terminal end of the multi-conduit and the portion of the multi-conduit adjacent to the surface of the wellbore.

3. The system of claim 2 further comprising an intake port comprising an integral U-connection positioned at the terminal end of the multi-conduit.

4. A system for removing liquid from a wellbore comprising:

a multi-conduit comprising at least two pipes extending into the wellbore from the surface of the wellbore, along a wellbore trajectory to a terminal end of the multi-conduit;

at least one intake port positioned within the wellbore, the intake port being in fluid communication with at least one pipe of the multi-conduit, the intake port comprising a liquid passage extending from the interior of the multi-conduit to the exterior of the intake port; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit; and a fluid connection between the at least two pipes of the multi-conduit wherein the wellbore trajectory comprises multiple low points in a horizontal section and the system further comprises multiple intake ports positioned at more than one low point in the horizontal section of the wellbore trajectory; wherein the multi-conduit comprises:

a first fluid accumulation pipe in fluid communication with the liquid passage of at least one intake port; and a vent pipe in fluid communication with the first fluid accumulation pipe.

5. The system of claim 4 further comprising a pressurized gas source and wherein the first fluid accumulation pipe and the vent pipe may be selectively pressurized by the application of pressurized gas from the pressurized gas source.

6. A system for removing liquid from a wellbore comprising:

a multi-conduit comprising at a plurality of pipes extending into the wellbore from a ground level end of the wellbore, along a wellbore trajectory to a terminal end of the multi-conduit;

at least one intake port positioned within the wellbore, the intake port being in fluid communication with at least one pipe of the multi-conduit, the intake port comprising a liquid passage extending from the interior of the multi-conduit to the exterior of the intake port; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit;

a fluid connection between the at least two pipes of the multi-conduit wherein the multi-conduit comprises:

a first fluid accumulation pipe in fluid communication with the liquid passage of at least one intake port;

a second fluid accumulation pipe in fluid communication with the liquid passage of at least one intake port and a vent pipe extending to the ground level end of the wellbore in fluid communication with the first fluid accumulation pipe and the second fluid accumulation pipe.

7. The system of claim 6 further comprising a pressurized gas source and wherein the first fluid accumulation pipe and the vent pipe may be selectively pressurized by the application of a pressurized gas.

8. A system for removing liquid from a wellbore comprising:

a multi-conduit comprising at least two pipes extending into the wellbore from the surface of the wellbore, along a wellbore trajectory to a terminal end of the multi-conduit;

at least one intake port positioned within the wellbore, the intake port being in fluid communication with at least one pipe of the multi-conduit; and a fluid connection between the at least two pipes of the multi-conduit, wherein the intake port comprises:

a housing providing for the support of at least one pipe of the multi-conduit;

an opening through the housing extending from the exterior of the housing to the interior of the multi-conduit pipe received in the opening, wherein the opening through the housing is configured to allow a quantity of wellbore liquid adjacent to the opening through the housing to pass through the opening through the housing, from outside of the multi-conduit to an interior region of the multi-conduit; and a check valve operatively associated with the opening through the housing, said check valve being positioned within the housing and providing for the opening through the housing to be closed when a pressure inside the multi-conduit pipe exceeds a pressure outside the opening through the housing and providing for the opening through the housing to be open when the pressure outside the opening through the housing exceeds the pressure inside the multi-conduit pipe.

9. The system of claim 8 wherein the intake port further comprises a back-flush port positioned adjacent to the opening through the housing and extending from the interior of the pipe to the exterior of the intake port housing, wherein the back-flush port is oriented such that liquid flowing through the back-flush port when the pressure in the multi-conduit exceeds the pressure outside the opening through the housing clears debris from the opening through the housing.

10. The system of claim 8 wherein the intake port check valve comprises:

a seat positioned in the opening through the housing; and a ball positioned in the opening through the housing between pipe and the seat such that pressure within the pipe causes the ball to mate with the seat and close the opening through the housing.

11. A method of removing liquid from a wellbore comprising:

providing a multi-conduit comprising at least two pipes extending into the wellbore from the surface of the wellbore, along a wellbore trajectory to a terminal end of the multi-conduit;

providing at least one intake port positioned within the wellbore, the intake port being in fluid communication with at least one pipe of the multi-conduit, wherein the intake port is configured to allow a quantity of wellbore liquid adjacent to the intake port to pass through a liquid passage, from outside of the multi-conduit to an interior region of the multi-conduit; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit;

providing a fluid connection between the at least two pipes of the multi-conduit;

causing the pressure in the multi-conduit to be less than the pressure outside the liquid passage, thereby allowing wellbore liquid adjacent to the intake port to flow through the liquid passage into the multi-conduit; and pressurizing at least one pipe of the multi-conduit causing the intake port check valve to close and forcing liquid in the multi-conduit to flow toward the surface of the wellbore through another pipe of the multi-conduit; and positioning the intake port at a low point in the wellbore trajectory between the terminal end of the multi-conduit and the portion of the multi-conduit adjacent to the surface of the wellbore.

12. The method of claim 11 further comprising providing a U-tube connection located at the terminal end of the multi-conduit.

13. The method of claim 11 wherein the wellbore trajectory comprises multiple low points and the method further comprises providing intake ports positioned at more than one low point in the wellbore trajectory.

14. A method of removing liquid from a wellbore comprising:

providing a multi-conduit comprising;

a first fluid accumulation pipe in fluid communication with the liquid passage of at least one intake port;

a second fluid accumulation pipe in fluid communication with the liquid passage of at least one intake port and a vent pipe in fluid communication with the first fluid accumulation pipe and the second fluid accumulation pipe, wherein the multi-conduit extends into the wellbore from the surface of the wellbore, along a wellbore trajectory to a terminal end of the multi-conduit;

providing at least one intake port positioned within the wellbore, the intake port being in fluid communication with at least one fluid accumulation pipe of the multi-conduit, the intake port comprising a liquid passage extending from the interior of the multi-conduit to the exterior of the intake port; the intake port further comprising a check valve operatively associated with the liquid passage and providing for the liquid passage to be closed when a pressure inside the multi-conduit exceeds a pressure outside the liquid passage and providing for the liquid passage to be open when the pressure outside the liquid passage exceeds the pressure inside the multi-conduit;

providing a fluid connection between the at least two pipes of the multi-conduit;

causing the pressure in the multi-conduit to be less than the pressure outside the liquid passage, thereby allowing liquid to flow through the liquid passage into the multi-conduit; and pressurizing at least one fluid accumulation pipe of the multi-conduit causing the intake port check valve to close and forcing liquid in the multi-conduit to flow toward the surface of the wellbore through the second fluid accumulation pipe of the multi-conduit.

venting gas from the vent pipe while causing the pressure in the first fluid accumulation pipe and the second fluid accumulation pipe to be less than the pressure outside the liquid passage, thereby allowing liquid to flow through the liquid passage into the multi-conduit; and pressurizing the first fluid accumulation pipe and the vent pipe forcing liquid in the multi-conduit to flow toward the surface of the wellbore through the second fluid accumulation pipe.

15. The method of claim 11 further comprising clearing debris from the from the fluid passage of the at least one intake port by flowing liquid through a back-flush port positioned adjacent to the liquid passage and extending from the multi-conduit to the exterior of the intake port.

16. The method of claim 11 further comprising pressurizing at least one pipe of the multi-conduit with a mixture of pressurized gas and solid spheres.

* * * * *